US010090118B2

(12) United States Patent
Katsube et al.

(10) Patent No.: US 10,090,118 B2
(45) Date of Patent: Oct. 2, 2018

(54) SWITCH

(71) Applicant: OMRON Corporation, Kyoto (JP)

(72) Inventors: Shinya Katsube, Okayama (JP); Kazuaki Morita, Shimane (JP); Hiroyuki Otsuka, Okayama (JP)

(73) Assignee: OMRON Corporation, Kyoto (JP)

( * ) Notice: Subject to any disclaimer, the term of this patent is extended or adjusted under 35 U.S.C. 154(b) by 28 days.

(21) Appl. No.: 15/341,037

(22) Filed: Nov. 2, 2016

(65) Prior Publication Data

US 2017/0133171 A1 May 11, 2017

(30) Foreign Application Priority Data

Nov. 6, 2015 (JP) ..... 2015-218918

(51) Int. Cl.

| | |
|---|---|
| ***H01H 1/20*** | (2006.01) |
| ***H01H 3/38*** | (2006.01) |
| ***H01H 1/50*** | (2006.01) |
| ***H01H 3/02*** | (2006.01) |
| ***H01H 13/50*** | (2006.01) |
| ***H01H 13/52*** | (2006.01) |

(52) U.S. Cl.

CPC ..... *H01H 3/38* (2013.01); *H01H 1/2025* (2013.01); *H01H 1/50* (2013.01); *H01H 3/022* (2013.01); *H01H 13/503* (2013.01); *H01H 13/52* (2013.01); *H01H 2013/525* (2013.01)

(58) Field of Classification Search

CPC ..... H01H 1/20; H01H 1/50; H01H 2013/525; H01H 1/2025; H01H 1/242; H01H 1/245; H01H 13/503; H01H 13/52; H01H 13/7006; H01H 13/14; H01H 13/22; H01H 3/38; H01H 3/60; H01H 3/3042; H01H 3/022; H01H 3/503

USPC ..... 200/16 B

See application file for complete search history.

(56) References Cited

U.S. PATENT DOCUMENTS

| | | | |
|---|---|---|---|
| 3,920,943 | A | 11/1975 | Lapointe |
| 4,112,284 | A | 9/1978 | Leworthy |
| 4,514,609 | A | 4/1985 | Fricke et al. |
| 2013/0192968 | A1 | 8/2013 | Schlegel et al. |

FOREIGN PATENT DOCUMENTS

| | | | |
|---|---|---|---|
| FR | 1476828 | A | 4/1967 |
| GB | 1231075 | A | 5/1971 |
| JP | 2013-541145 | A | 11/2013 |

OTHER PUBLICATIONS

Extended European Search Report issued in corresponding European Application No. 16195484.7, dated Mar. 10, 2017 (10 pages).

*Primary Examiner* — Anthony R Jimenez

(74) *Attorney, Agent, or Firm* — Osha Liang LLP

(57) ABSTRACT

Provided is a switch that can be downsized. A switch is provided with a plunger, two upper torsion springs that bias the plunger in a returning direction, housing-side contacts, and plunger-side contacts. One of the upper torsion springs is arranged on one side of a plane that includes an axis passing through a central portion of the plunger, and that is perpendicular to perpendicular lines M connecting the plunger-side contacts and the axis, and the other one of the upper torsion springs is arranged on the other side of the plane.

7 Claims, 12 Drawing Sheets

SWITCH

CROSS-REFERENCES TO RELATED APPLICATIONS

This application claims priority to Japanese Patent Application No. 2015-218918 filed Nov. 6, 2015, the entire contents of which are incorporated herein by reference.

FIELD

The present invention relates to a switch.

BACKGROUND

Conventionally, regarding switches for opening and closing contacts according to the movement of a plunger, switches that are provided with a coil spring for returning the plunger are known. For example, JP 2013-541145A discloses an emergency stop switch that is provided with a coil spring on a lower side in a direction in which the plunger moves.

JP 2013-541145A (published on Nov. 7, 2013) is an example of background art.

SUMMARY

However, in the configuration of a switch, such as that disclosed in JP 2013-541145A, that is provided with a coil spring on the lower side in a direction in which the plunger moves, there is the problem that the switch has a large size in the direction in which the plunger moves.

Accordingly, it is conceivable to use, instead of the coil spring, a torsion spring as a spring for returning the plunger, but the switch provided with the torsion spring is also required to be further downsized due to the limitation of an installation place of the switch, or the like. Note that "torsion spring" refers to a spring that includes a coil wire portion, and two arms extending from both ends of the coil wire portion, and that is configured such that one of the two arms is fixed, and thereby the other arm applies a biasing force in a direction of rotation about the axis of the coil wire portion.

Here, in order to downsize the switch provided with a torsion spring, it is conceivable to use a short-armed torsion spring. However, the angle of rotation of the arms, which corresponds to the amount of movement of the plunger, is larger when using a short-armed torsion spring than when using a long-armed torsion spring. Accordingly, the position at which the torsion spring is in contact with the plunger largely changes depending on the movement of the plunger, causing the problem that a biasing force does not act on the plunger in a balanced manner.

The present invention was made in view of the above-described problems, and it is an object thereof to provide a switch that can be downsized.

In order to solve the above-described problems, according to the present invention, a switch is provided with a plunger configured to linearly move from a reference position to an operation position in response to an operation performed on an operation portion, and is configured to open and close contacts according to the movement of the plunger, the switch including: a first torsion spring and a second torsion spring that are configured to bias the plunger in a returning direction from the operation position to the reference position; and a fixed contact, and a movable contact configured to move together with the plunger, the fixed contact and the movable contact serving as the contacts, wherein a plane includes an axis that passes through a central portion of the plunger and is parallel to a direction in which the plunger moves, and is perpendicular to a perpendicular line connecting the movable contact and the axis, the first torsion spring is arranged on one side of the plane, and the second torsion spring is arranged on the other side of the plane. Here, "reference position" refers to a position of the plunger in a state in which no operation is performed on the operation portion, and "operation position" refers to a position of the plunger in a state in which the amount of operation of the operation portion is the greatest.

According to the foregoing configuration, two torsion springs, namely, the first torsion spring arranged on one side of the plane, and the second torsion spring arranged on the other side of the plane, are provided, and thus even if short-armed torsion springs are used, and the positions at which the torsion springs are in contact with the plunger change according to movement of the plunger, it is possible for a biasing force to act on the plunger in a balanced manner. Accordingly, it is possible to use short-armed torsion springs, which generates space for arranging another member of the switch, and makes it possible to downsize the switch.

Furthermore, preferably, the switch according to the present invention is such that the first torsion spring and the second torsion spring are arranged at positions symmetric with respect to the axis.

According to the foregoing configuration, as a result of two torsion springs being arranged at positions symmetric with respect to the axis of the plunger, it is possible for a biasing force to act on the plunger uniformly. Accordingly, it is possible to provide a switch with excellent operability.

Furthermore, preferably, the switch according to the present invention is such that each of the first torsion spring and the second torsion spring has an arm that extends to the plunger, and abuts against the plunger, and the arm of the first torsion spring and the arm of the second torsion spring are provided so as to be symmetric with respect to the axis.

According to the foregoing configuration, as a result of, in addition to two torsion springs being arranged at positions symmetric with respect to the axis of the plunger, the arms of the torsion springs being provided so as to be symmetric with respect to the axis, a biasing force acts on the plunger more uniformly. Accordingly, it is possible to provide a switch with more excellent operability.

Furthermore, preferably, the switch according to the present invention is such that the arms, when viewed in the direction in which the plunger moves, extend in a direction that is perpendicular to the plane, a front end portion of the arm of the first torsion spring abuts against the plunger on the one side in the reference position, and is located on the other side in the operation position, and a front end portion of the arm of the second torsion spring abuts against the plunger on the other side in the reference position, and is located on the one side in the operation position.

According to the foregoing configuration, when viewed in a direction that is perpendicular to the axis and is perpendicular to the direction in which the arms extend, the arm of the first torsion spring and the arm of the second torsion spring do not intersect with each other in the reference position, but the arms intersect with each other in the operation position. Accordingly, even with such a configuration, it is possible for a biasing force to act on the plunger uniformly. Accordingly, it is possible to provide a switch with excellent operability.

Furthermore, preferably, the switch according to the present invention is such that the plunger has a first inclined surface that is provided at a position at which the first torsion spring abuts against the plunger, and a second inclined surface that is provided at a position at which the second torsion spring abuts against the plunger, the first inclined surface is inclined in the returning direction from the one side to the other side, and the second inclined surface is inclined in the returning direction from the other side to the one side.

According to the foregoing configuration, as a result of the positions at which the first torsion spring and the second torsion spring abut against the plunger being located on the inclined surfaces, the likelihood of the first torsion spring and the second torsion spring getting caught on the plunger while the plunger moves from the reference position to the operation position is reduced. Accordingly, it is possible to provide a switch with excellent operability and durability.

According to the present invention, it is possible to provide a switch that can be downsized.

DETAILED DESCRIPTION

Hereinafter, embodiments of the present invention will be described in detail with reference to the drawings.

1. Overview of Configuration of Switch

Figure 1:
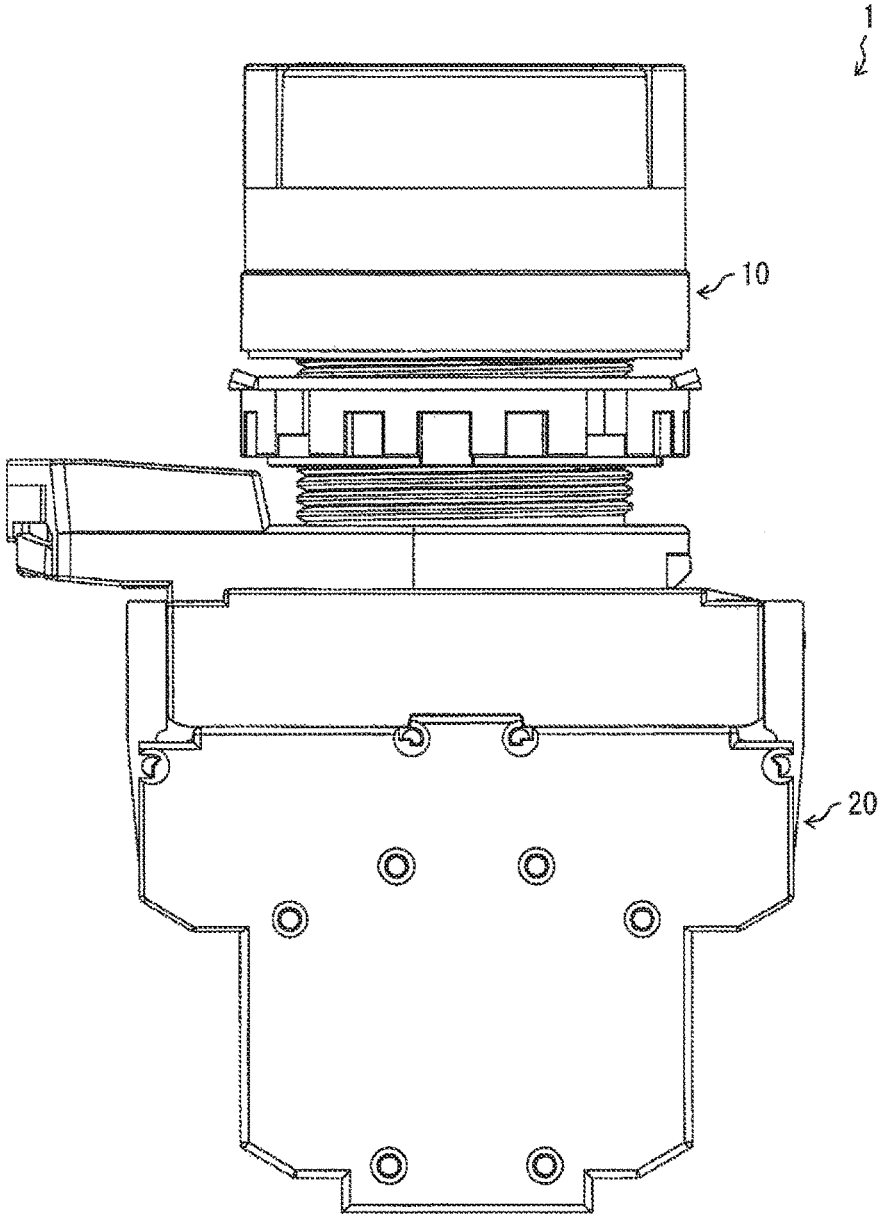
FIG. 1 is a front view illustrating an external appearance of a switch according to an embodiment of the present invention.

FIG. 1 is a front view illustrating an external appearance of a switch 1 according to the present embodiment. As shown in FIG. 1, the switch 1 is provided with an operation portion 10, and a main body portion 20.

The operation portion 10 is a member for accepting an operation performed by an operator, and is provided so as to be able to perform a press-in operation performed on the main body portion 20. Note that the present embodiment will describe a press button switch for accepting a press-in operation performed by an operator, but the present invention is not limited to this. For example, the switch 1 may be provided with a cam mechanism for converting a rotational operation into a press-in operation, and the operation portion 10 may be configured to accept a rotational operation performed by an operator.

Figure 2A:
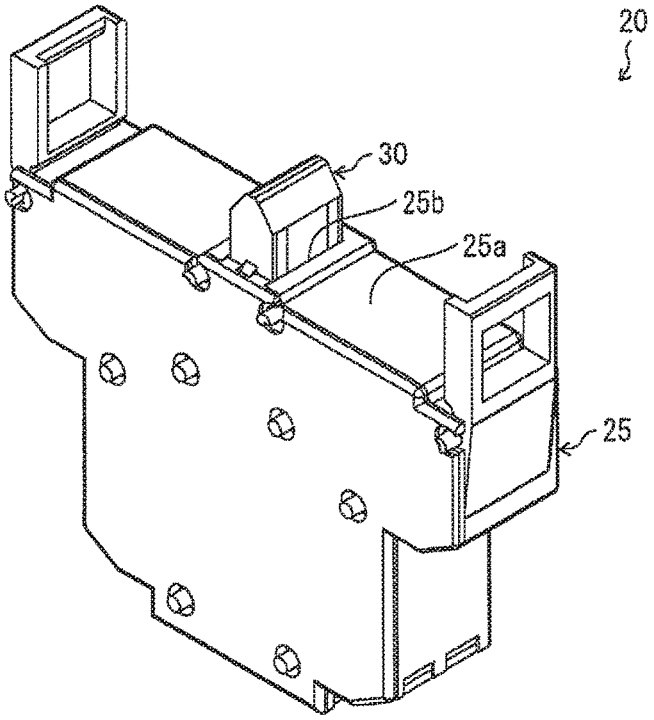
FIG. 2A is a perspective view illustrating an external appearance of a main body portion included in the switch shown in FIG. 1.
Figure 2B:
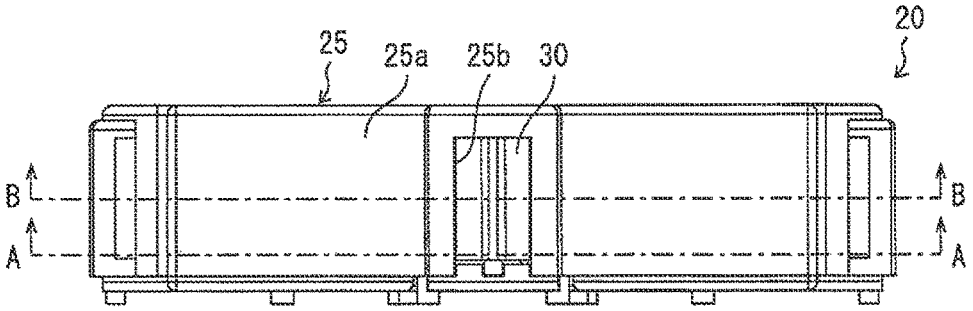
FIG. 2B is a top view of the main body portion shown in FIG. 2A.
Figure 3:
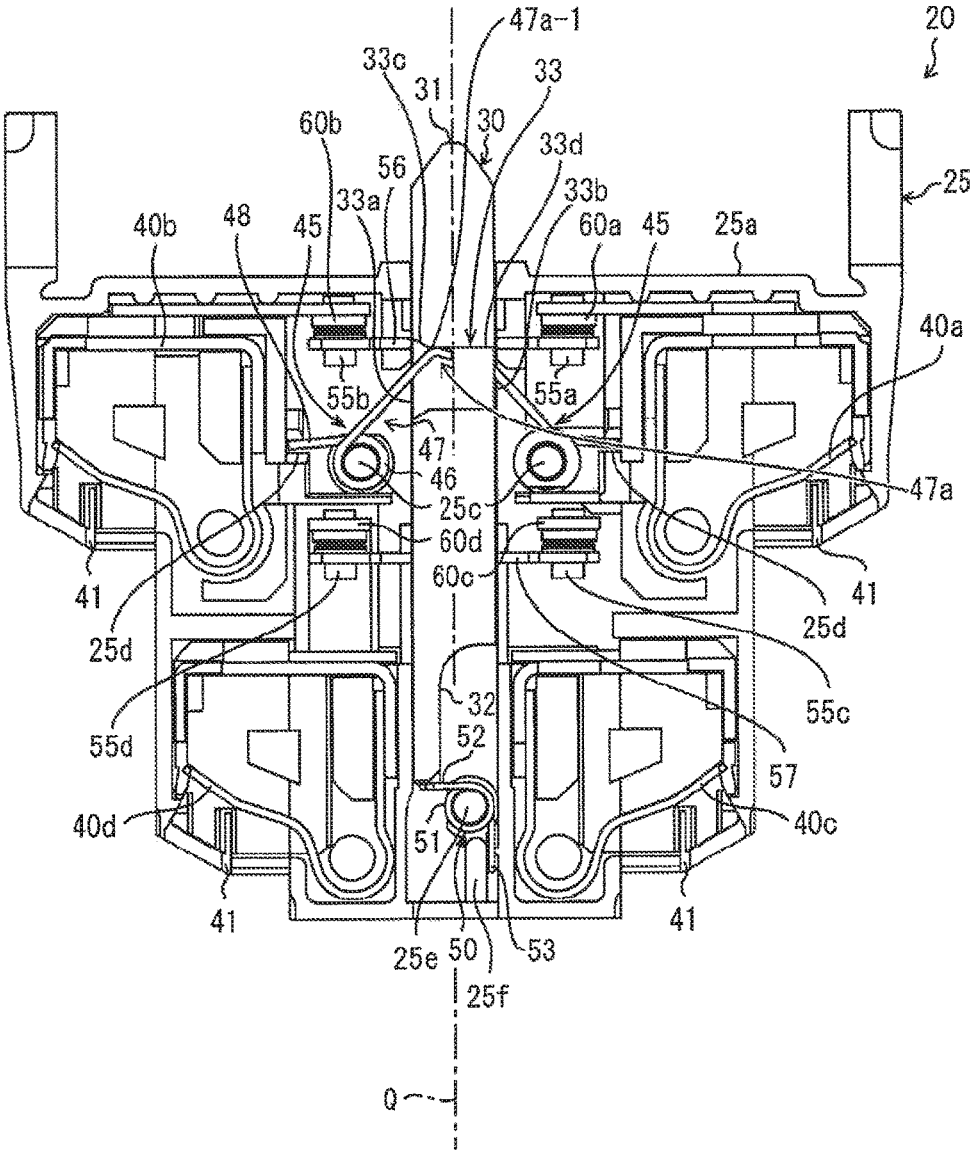
FIG. 3 is a cross-sectional view taken along a line A-A of FIG. 2B of the main body portion.
Figure 4:
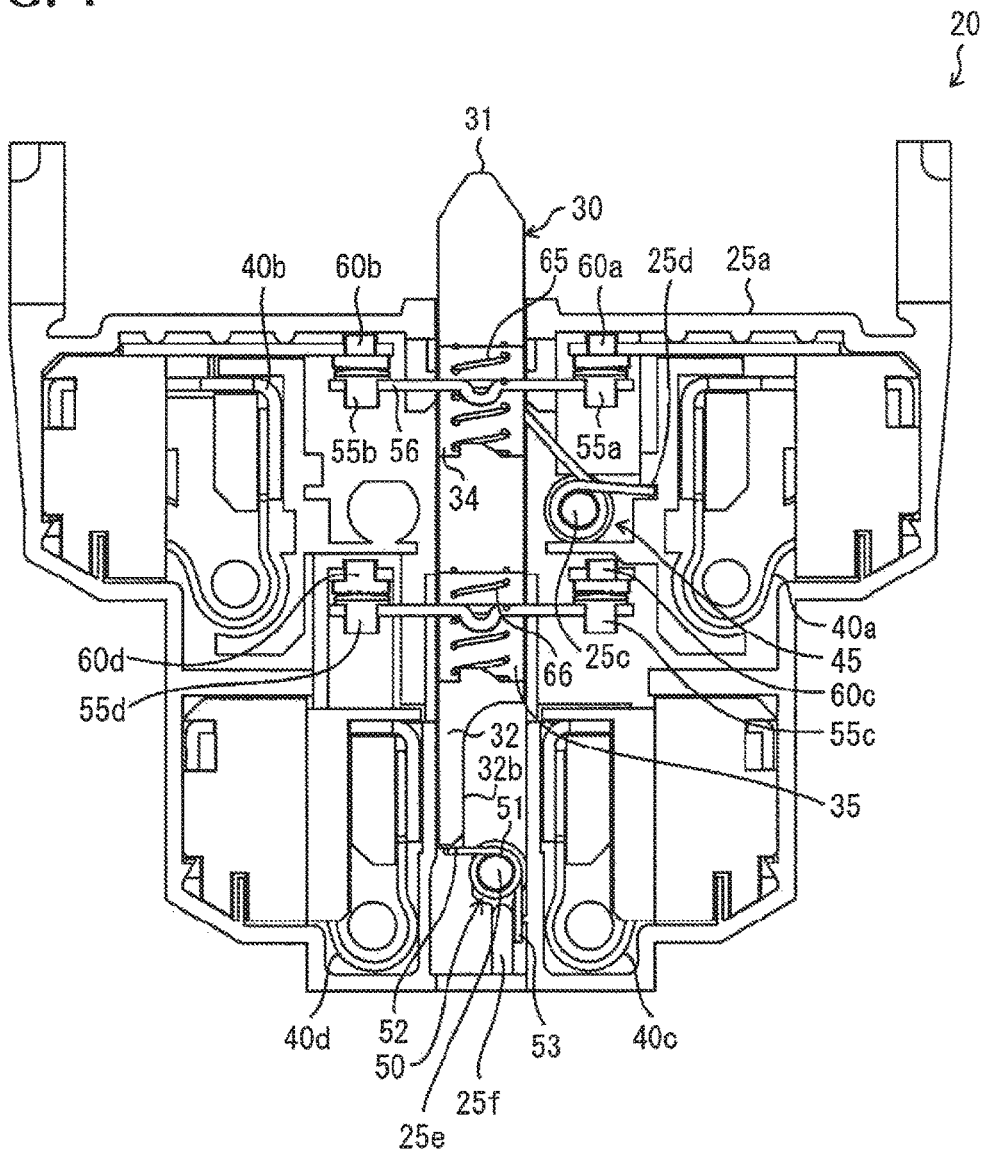
FIG. 4 is a cross-sectional view taken along a line B-B of FIG. 2B of the main body portion.

FIG. 2A is a perspective view illustrating an external appearance of the main body portion 20, and FIG. 2B is a top view of the main body portion 20. Furthermore, FIG. 3 is a cross-sectional view taken along a line A-A of FIG. 2B of the main body portion 20, and FIG. 4 is a cross-sectional view taken along a line B-B of FIG. 2B of the main body portion 20. Note that, for convenience of illustration, in the following, "lower (downward)" refers to a direction in which the switch 1 is pressed in and "upper (upward)" refers to the opposite direction, but the direction in which the switch 1 is mounted is not limited to this.

The switch 1 is a normally-closed switch, in which contacts are in contact with each other when the switch is not operated. As shown in FIGS. 3 and 4, the main body portion 20 of the switch 1 includes a housing 25, a plunger 30, four terminals 40*a* to 40*d*, two upper torsion springs 45, a lower torsion spring 50, an upper contact-supporting member 56, a lower contact-supporting member 57, four housing-side contacts (fixed contacts) 60*a* to 60*d*, an upper coil spring 65, and a lower coil spring 66.

The housing 25 is box-shaped, and holds, in the inside thereof, the constituent components of the main body portion 20. Furthermore, the housing 25 has a hole 25*b* in the center of an upper surface 25*a* thereof.

Figure 5A:
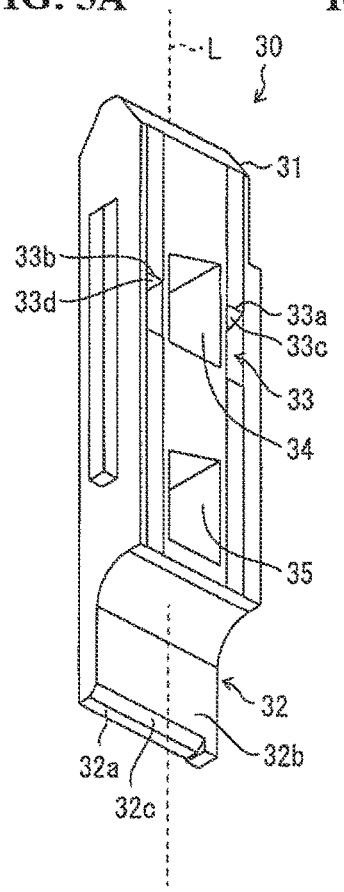
FIG. 5A is a perspective view of a plunger included in the main body portion shown in FIG. 2, and FIGS. 5B and 5C are plan views of the plunger.
Figure 5B:
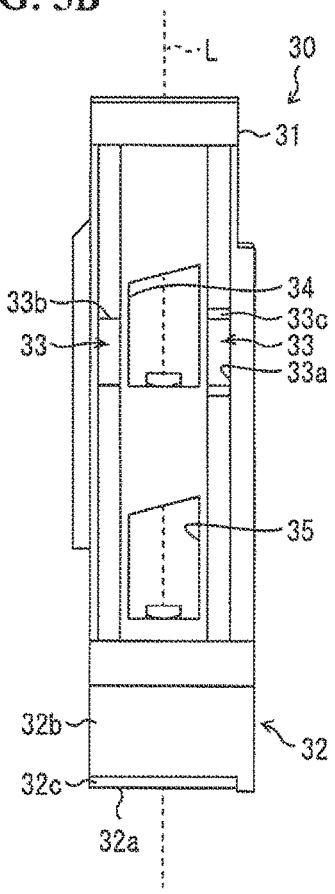
Figure 5C:
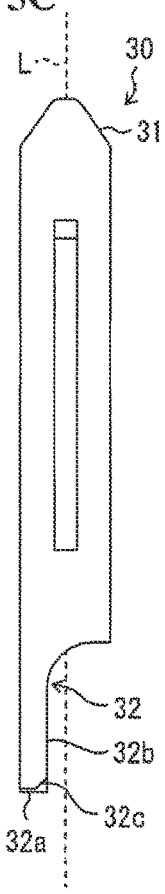

FIG. 5A is a perspective view of the plunger 30, and FIGS. 5B and 5C are side views of the plunger 30. The switch 1 is a switch for opening and closing the contacts according to movement of the plunger 30. The plunger 30 is arranged so that an upper end portion 31 thereof protrudes from the hole 25*b* of the housing 25 and abuts against the operation portion 10. Therefore, the plunger 30 moves downward in response to a press-in operation performed on the operation portion 10 by an operator. In other words, in response to an operation performed on the operation portion 10, the plunger 30 linearly moves from a reference position, in which no operation is performed on the operation portion 10, to an operation position, in which the amount of operation performed on the operation portion 10 is the greatest. Furthermore, the plunger 30 has, at the lower end thereof, a substantially plate-shaped hanging portion 32 that extends downward. The hanging portion 32 has an inclined surface 32*c* that extends from a lower end surface 32*a* to an inner side surface 32*b*.

The plunger 30 has, between the upper end portion 31 and the hanging portion 32 of in the direction in which the plunger 30 moves, two holes 33, an upper coil spring supporting portion 34, and a lower coil spring supporting portion 35. The two holes 33, the upper coil spring supporting portion 34, and the lower coil spring supporting portion 35 are each a through-hole that extends in a direction perpendicular to the vertical direction in which the plunger 30 moves.

The upper coil spring supporting portion 34 and the lower coil spring supporting portion 35 are formed in the central part in the width direction of the plunger 30, and have substantially the same shape. Furthermore, the upper coil spring supporting portion 34 is formed on the upper side in the direction in which the plunger 30 moves, and the lower coil spring supporting portion 35 is formed on the lower side in the direction in which the plunger 30 moves.

The two holes 33 are respectively formed on the outer sides of the upper coil spring supporting portion 34 formed in the central part. Each hole 33 has two openings 33*a* and 33*b* of different sizes, and the opening 33*a* has a larger length in the direction in which the plunger 30 moves than that of the opening 33*b*. The hole 33 has, between an upper surface 33*d* and the opening 33*a*, an inclined surface 33*c* that is inclined upward from the opening 33*b* side to the opening 33*a*. Furthermore, the two holes 33 are formed so as to be symmetric with respect to an axis L that passes through a central portion 30*a* (see FIG. 6) of the plunger, and is parallel to the direction in which the plunger 30 moves. That is, the opening 33*a* of one hole 33 and the opening 33*b* of the other hole 33 are formed in one side surface of the plunger 30, and the opening 33*b* of the one hole 33 and the opening 33*a* of the other hole 33 are formed in the opposite side surface. Note that the axis L is, in other words, an axis that is parallel to the direction in which the plunger 30 moves, and passes through a part in which the upper contact-supporting member 56 intersects with the plunger 30, and a part in which the lower contact-supporting member 57 intersects with the plunger 30.

The upper coil spring 65 is arranged in the upper coil spring supporting portion 34 of the plunger 30. Similarly, the lower coil spring 66 is arranged in the lower coil spring supporting portion 35 of the plunger 30.

The terminals 40*a* to 40*d* are press-in type terminals, and are electrically connected to external devices as a result of cords or the like being inserted through insertion ports 41 provided, in the housing 25. The switch 1 according to the present embodiment is a two-stage switch in which the pair of terminals 40*a* and 40*b* are provided on the upper side, and the pair of terminals 40*c* and 40*d* are provided on the lower side.

The housing-side contacts 60*a* to 60*d* are respectively electrically connected to the corresponding terminals 40*a* to 40*d*. Specifically, the housing-side contact 60*a* is connected to the terminal 40*a*, the housing-side contact 60*b* is connected to the terminal 40*b*, the housing-side contact 60*c* is connected to the terminal 40*c*, and the housing-side contact 60*d* is connected to the terminal 40*d*. That is, the pair of housing-side contacts 60*a* and 60*b* are provided on the upper side, and the pair of housing-side contacts 60*c* and 60*d* are provided on the lower side.

The upper contact-supporting member 56 is inserted through the upper coil spring supporting portion 34. Furthermore, the upper contact-supporting member 56 is fixed to the upper coil spring 65, and operates together with the upper coil spring 65, that is, the plunger 30. Similarly, the lower contact-supporting member 57 is inserted through the lower coil spring supporting portion 35. Furthermore, the lower coil spring supporting portion 35 is fixed to the lower coil spring 66, and operates together with the lower coil spring 66, that is, the plunger 30.

The upper contact-supporting member 56 is provided with a pair of plunger-side contacts 55*a* and 55*b*. Furthermore, the lower contact-supporting member 57 is provided with a pair of plunger-side contacts 55*c* and 55*d*. Accordingly, the plunger-side contacts (movable contacts) 55*a* to 55*d* move together with the plunger 30. Note that the plunger-side contact 55*a* and the plunger-side contact 55*b* are provided at positions that are symmetric with respect to the axis L, and the plunger-side contact 55*c* and the plunger-side contact 55*d* are provided at positions that are symmetric with respect to the axis IL. That is, the axis L is an axis that is parallel to the direction in which the plunger 30 moves, and passes through the midpoint between the plunger-side contact 55*a* and the plunger-side contact 55*b*, and the midpoint between the plunger-side contact 55*c* and the plunger-side contact 55*d*.

The plunger-side contacts 55*a* to 55*d* are respectively provided at positions at which they are opposed to the corresponding housing-side contacts 60*a* to 60*d*, and are provided so as to be able to open and close with respect to the housing-side contacts 60*a* to 60*d*. In the reference position shown in FIGS. 3 and 4, the plunger-side contacts 55*a* to 55*d* are respectively in contact with the housing-side contacts 60*a* to 60*d*. That is, in the reference position, the plunger-side contact 55*a* is in contact with the housing-side contact 60*a*, and similarly, the plunger-side contact 55*b* is in contact with the housing-side contact 60*b*, the plunger-side contact 55*c* is in contact with the housing-side contact 60*c*, and the plunger-side contact 55*d* is in contact with the housing-side contact 60*d*. Here, in the state shown in FIGS. 3 and 4, the upper contact-supporting member 56 is biased upward by the upper coil spring 65, and the lower contact-supporting member 57 is biased upward by the lower coil spring 66. Therefore, even if the plunger 30 is somewhat moved by vibration from the outside or the like, the upper contact-supporting member 56 and the lower contact-supporting member 57 do not move. Accordingly, the upper coil spring 65 and the lower coil spring 66 place, in the reference position, the plunger-side contacts 55*a* to 55*d* in contact with the housing-side contacts 60*a* to 60*d*.

Furthermore, the plunger-side contact 55*a* and the plunger-side contact 55*b* are electrically connected to each other, and the plunger-side contact 55*c* and the plunger-side contact 55*d* are electrically connected to each other. That is, in the state shown in FIGS. 3 and 4, the terminal 40*a* and the terminal 40*b* are electrically connected, to each other, and the terminal 40*c* and the terminal 40*d* are electrically connected to each other.

Figure 6:
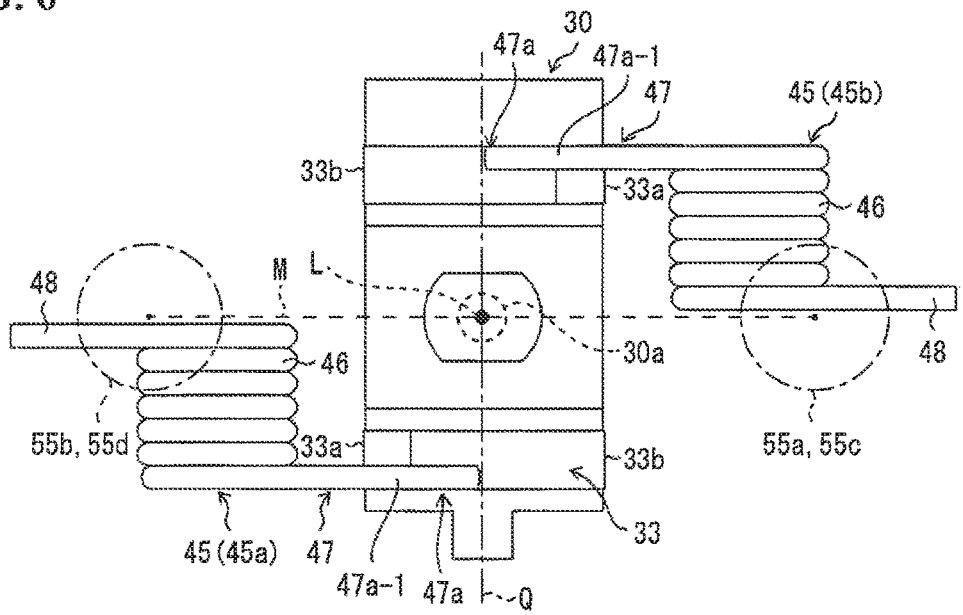
FIG. 6 is a cross-sectional view illustrating a positional relationship between the plunger and upper torsion springs that are included in the main body portion shown in FIG. 2.
Figure 7A:
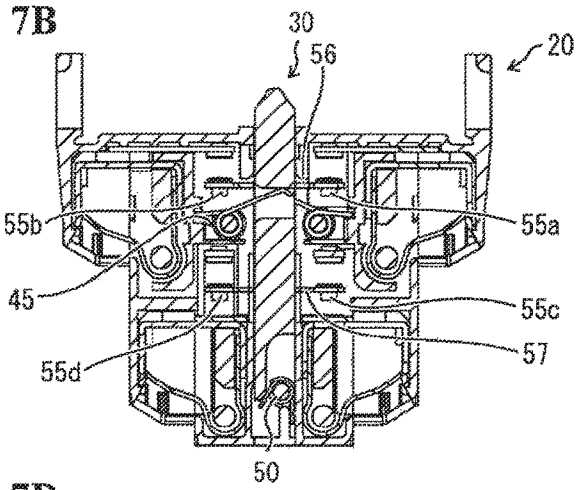
FIGS. 7A to 7D are diagrams illustrating states of the main body portion when an operation is performed on an operation portion of the switch.
Figure 7B:
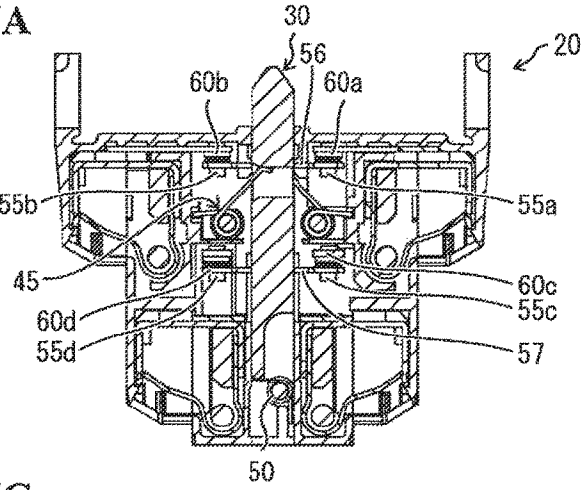
Figure 7C:
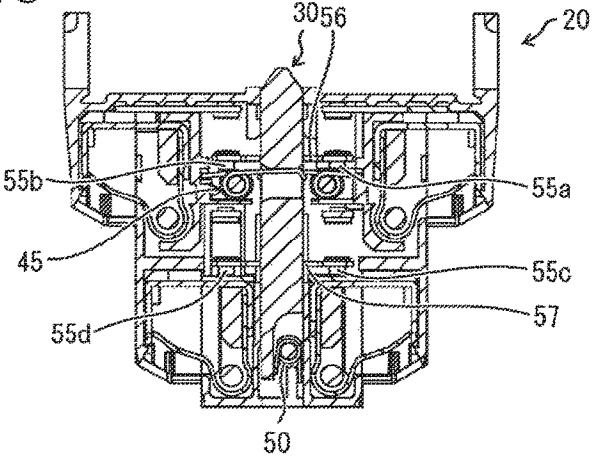
Figure 7D:
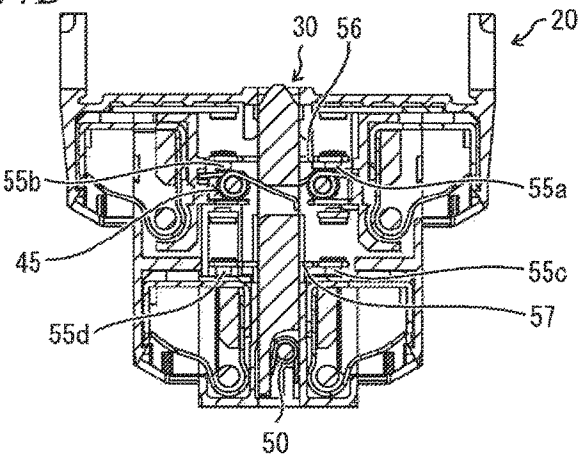

FIG. 6 is a cross-sectional view illustrating a positional relationship between the plunger 30 and the upper torsion springs 45. Furthermore, in FIG. 6, the positions of the plunger-side contacts 55*a* to 55*d* are indicated by virtual lines. Note that in the following, the reference numerals 45*a* and 45*b* are respectively given to the two upper torsion springs 45 when they are distinguished from each other, and the reference numeral 45 is given to the two upper torsion springs 45 when they are not distinguished from each other.

The two upper torsion springs 45 are springs for biasing the plunger 30 in a returning direction from the operation position to the reference position. The two upper torsion springs 45 are respectively arranged on one side and the other side of a plane Q, which is defined as a plane that includes the axis L passing through the central portion 30*a* of the plunger 30, and is perpendicular to perpendicular lines M connecting the plunger-side contacts (movable contacts) 55*a* to 55*d* and the axis L. That is, the upper torsion spring (first torsion spring) 45*a* is arranged on one side of the plane Q, and the upper torsion spring (second torsion spring) 45*b* is arranged on the other side of the plane Q.

Furthermore, the two upper torsion springs 45 are arranged at positions that are symmetric with respect to the axis L, similar to the above-described two holes 33. Since the two upper torsion springs 45 are arranged at positions symmetric with respect to the axis L of the plunger 30 in this way, it is possible for a biasing force to act on the plunger 30 uniformly. Note that the plane Q is, in other words, a plane that is perpendicular to a straight line connecting the plunger-side contact 55*a* and the plunger-side contact 55*b*, and to a straight line connecting the plunger-side contact 55*c* and the plunger-side contact 55*d*.

The upper torsion springs 45 include a coil wire portion 46, a first arm (arm) 47 that extends from one end of the coil wire portion 46 to the plunger 30 and abuts against the plunger 30, and a second arm 48 that extends from the other end of the coil wire portion 46. The upper torsion springs 45 are supported by columnar spring holding portions 25*c* provided in the housing 25 being respectively arranged in hollow parts of the coil wire portions 46. Furthermore, the second arms 48 of the upper torsion springs 45 are respectively fixed by locking portions 25*d* provided on the housing 25. As shown in FIG. 3, the first arm 47 of each upper torsion spring 45 has, in a front end portion 47*a* thereof, a bent portion 47*a*-1 in which the extending direction of the first arm 47 is changed. The bent portion 47*a*-1 is obtained by the front end portion 47*a* being bent downward in the direction in which the plunger 30 moves relative to the direction in which the part of the first arm 47 between the bent portion 47*a*-1 and the coil wire portion 46 extends.

Here, the first arm 47 of the upper torsion spring 45*a* and the first arm 47 of the upper torsion spring 45*b* are arranged so as to be symmetric with respect to the axis L. As a result of, in addition to the two upper torsion springs 45 being arranged at positions symmetric with respect to the axis LA of the plunger 30, the first arms 47 of the upper torsion springs 45 being provided so as to be symmetric with respect to the axis L, a biasing force acts on the plunger 30 more uniformly.

Note that, as shown in FIG. 6, the first arms 47 of the upper torsion springs 45*a* and 45*b*, when viewed in the direction in which the plunger 30 moves, extend in a direction perpendicular to the plane Q. Furthermore, the holes 33 of the plunger 30, when viewed in the direction in which the plunger 30 moves, extends in the same direction as the direction in which the first arms 47 of the upper torsion springs 45 extend.

In the reference position shown in FIGS. 3 and 4, the upper torsion springs 45 are arranged so that the first arms 47 are respectively inserted into the holes 33 via the openings 33*a* of the holes 33, and the bent portions 47*a*-1 of the front end portions 47*a* respectively abut against the upper surfaces 33*d* of the holes 33. Here, the upper torsion springs 45 are provided so as to bias the plunger 30 to the second arm 48 side (outside of the switch 1), and therefore the upper torsion springs 45 bias the plunger 30 upward (in the returning direction).

The lower torsion spring 50 places, in the reference position, the plunger-side contacts 55*a* to 55*d* in contact with the housing-side contacts 60*a* to 60*d*. The lower torsion spring 50 includes a coil wire portion 51, a first arm 52 that extends from one end of the coil wire portion 51, and a second arm 53 that extends from the other end of the coil wire portion 51. The lower torsion spring 50 is supported by a columnar spring holding portion 25*e* provided on the housing 25 being arranged in a hollow part of the coil wire portion 51. The second arm 53 of the lower torsion spring 50 is fixed by a locking portion 25*f* provided on the housing 25.

In the state shown in FIGS. 3 and 4, the first arm 52 of the lower torsion spring 50 abuts against the lower end surface 32*a* of the plunger 30. Here, the lower torsion spring 50 is provided so as to be biased to the second arm 53 side, and therefore the lower torsion spring 50 biases the plunger 30 upward (in the returning direction).

2. Description of Operations of Switch

The following will describe operation of the main body portion 20 when an operator performs an operation performed on the operation portion 10 of the switch 1.

FIG. 7 are diagrams illustrating states of the main body portion 20 when an operation is performed on the operation portion 10 of the switch 1. FIG. 7A shows the state in which no operation is performed (reference position), and the amount of press of the plunger 30 increases in order of FIG. 7B, FIG. 7C, and FIG. 71), which shows the state in which the amount of press of the plunger 30 is the greatest (operation position). Furthermore, FIGS. 8A to 8D are schematic diagrams illustrating operation of the upper torsion springs 45, and FIGS. 8A to 8D correspond to FIGS. 7A to 7D. Furthermore, FIGS. 9A to 9D are schematic diagrams illustrating operation of the lower torsion spring 50, and FIGS. 9A to 9) correspond to FIGS. 7A to 7D.

Figure 8A:
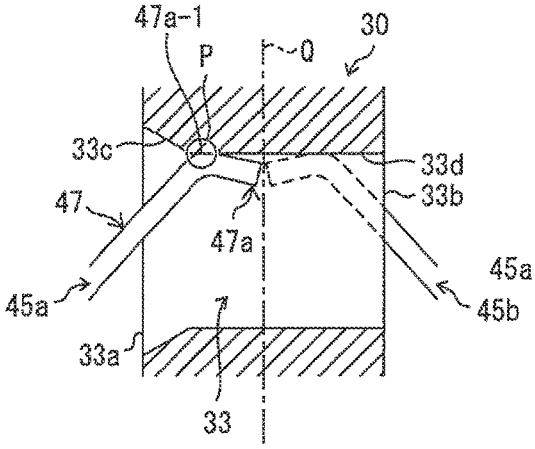
FIGS. 8A to 8D are schematic diagrams illustrating operation of the upper torsion springs.
Figure 9A:
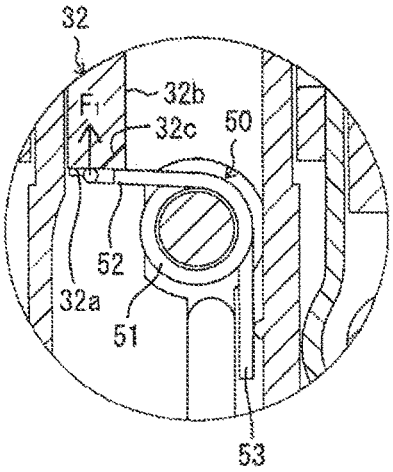
FIGS. 9A to 9D are schematic diagrams illustrating operation of a lower torsion spring.

As shown in FIG. 8A, while no operation is performed, the bent portions 47*a*-1 provided in the front end portions 47*a* of the first arms 47 of the upper torsion springs 45 abut against the upper surfaces 33*d* of the holes 33 of the plunger 30 in regions P, and thus the upper torsion springs 45 bias the plunger 30 upward. Furthermore, as shown in FIG. 9A, the first arm 52 of the lower torsion spring 50 abuts against the lower end surface 32*a* of the hanging portion 32 of the plunger 30, and the lower torsion spring 50 biases the plunger 30 upward as denoted by an arrow $F_1$, achieving reliable contact between the plunger-side contacts 55*a* to 55*d* and the housing-side contacts 60*a* to 60*d*.

When an operation is performed on the operation portion 10, and the plunger 30 is pressed against the biasing force of the upper torsion springs 45 and the lower torsion spring 50, the upper contact-supporting member 56 and the lower contact-supporting member 57, which operate together with the plunger 30, also move downward. Accordingly, the plunger-side contacts 55*a* to 55*d* are no longer in contact with the housing-side contacts 60*a* to 60*d*, the terminal 40*a* and the terminal 40*b* are no longer conductive with each other, and the terminal. 40*c* and the terminal 40*d* are no longer conductive with each other (see FIGS. 7B to 7D).

2.1 Operations of Upper Torsion Springs

Here, each upper torsion spring 45 is provided with the bent portion 47*a*-1 in the front end portion 47*a* of the first arm 47, and the bent portion 47*a*-1 abuts against the plunger 30 when no operation is performed. Accordingly, the place at which the upper torsion spring 45 abuts against the plunger 30 is located on a curved surface. Accordingly, the upper torsion springs 45 do not get caught when the plunger 30 is pressed. This makes it possible to perform the operation of the switch 1 smoothly, and to improve the operability and durability.

Then, the upper torsion spring 45 slides on the upper surface 33*d*, located on the side in the returning direction of the plunger 30, of the hole 33 according to the downward movement of the plunger 30. Accordingly, the first arm 47 of the upper torsion spring 45 is also rotated downward. Accordingly, as shown in FIG. 8B, the region P in which the upper torsion spring 45 abuts against the plunger 30 also moves toward the opening 33*b*.

Figure 8B:
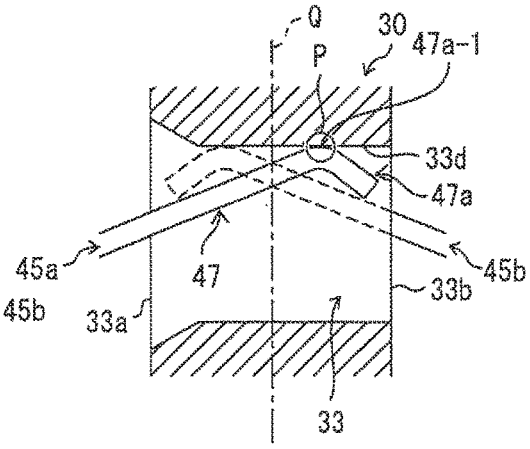
Figure 8C:
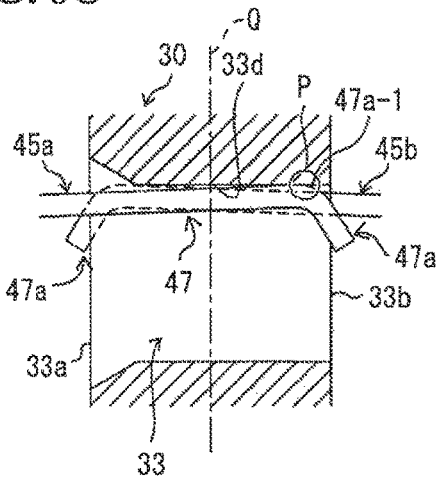
Figure 8D:
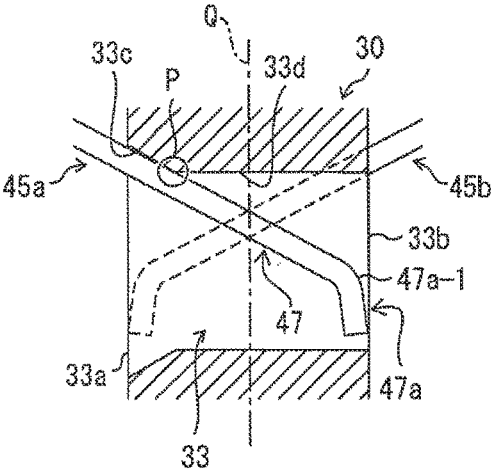

When the plunger 30 is further pressed down from the state shown in FIG. 8B, the first arm 47 of the upper torsion spring 45 is further rotated, and also the region P in which the upper torsion spring 45 abuts against the plunger 30 further moves toward the opening 33*b* (FIG. 8C). When the angle of rotation of the first arm 47 of the upper torsion spring 45 increases, and the part of the first arm 47 between the bent portion 47*a*-1 and the coil wire portion 46 is rotated downward from the angle parallel to the upper surface 33*d* of the hole 33, that is, from being horizontal, as shown in FIG. 8D, the region P in which the upper torsion spring 45 abuts against the plunger 30 is at the boundary between the upper surface 33*d* and the inclined surface 33*c* of the hole 33. Thereafter, the region P in which the upper torsion spring 45 abuts against the plunger 30 does not move until the operation position, in which the amount of press of the plunger 30 is the greatest.

Accordingly, since the region P in which the upper torsion spring 45 abuts against the plunger 30 moves, the load necessary for pressing down the plunger 30 for the same length changes. That is, the load necessary for pressing down the plunger 30 changes according to the length from the coil wire portion 46 of the upper torsion spring 45 to the region P in which the upper torsion spring 45 abuts against the plunger 30, and the angle of rotation of the first arm 47 from the reference position. Note that during the movement of the plunger from the reference position to the operation position, the angle by which the first arm of the upper torsion spring 45 is rotated is preferably in a range from 1200 to 2200.

Here, a case is considered in which no inclined surface 33*c* is provided in the holes 33 of the plunger 30. In such a case, when the angle of rotation of the first arm 47 of each upper torsion spring 45 increases, and the first arm 47 is rotated downward from being horizontal, the region P in which the upper torsion spring 45 abuts against the plunger 30 moves to the opening 33*a* of the hole 33. Accordingly, the length from the coil wire portion 46 of the upper torsion spring 45 to the region P in which the upper torsion spring 45 abuts against the plunger 30 drastically changes, and the load necessary for pressing down the plunger 30 drastically increases when the first arm 47 is rotated beyond being horizontal, resulting in deterioration of the operability of the switch 1.

In contrast, in the switch 1 according to the present embodiment, each hole 33 of the plunger 30 has the inclined surface 33*c* on the upper surface 33*d* of the opening 33*a* on the side into which the first arm 47 of the corresponding upper torsion spring 45 is inserted. Accordingly, even if the first arm 47 is rotated downward from the horizon, the region P in which the upper torsion spring 45 abuts against the plunger 30 is located at the boundary between the upper surface 33*d* and the inclined surface 33*c* of the hole 33. Accordingly, it is possible to reduce the change in length from the coil wire portion 46 of the upper torsion spring 45 to the region P in which the upper torsion spring 45 abuts against the plunger 30, and to provide a switch 1 with excellent operability.

Furthermore, in the reference position as shown in FIG. 8A, the first arm 47 of the upper torsion spring 45 has a gap between the part of its front end portion 47*a* that is located further forward than the bent portion 47*a*-1, and the upper surface 33*d* of the hole 33 of the plunger 30. When, as shown in FIG. 8B, the plunger 30 is moved and the first arm 47 is rotated, the gap increases. Therefore, if the first arm 47 of the upper torsion spring 45 has, in the reference position, a gap between the part of its front end portion 47*a* that is further forward than the bent portion 47*a*-1, and the upper surface 33*d* of the hole 33 of the plunger 30, the front end portion 47*a* of the first arm 47 does not get caught on the plunger 30 even when the plunger 30 is moved, and thus it is possible to provide a switch 1 with excellent operability and durability.

Furthermore, the switch 1 according to the present embodiment is provided with two upper torsion springs 45, namely, the upper torsion spring 45*a* arranged on one side of the plane Q and the upper torsion spring 45*b* arranged on the other side of the plane Q. Here, in order to downsize a switch provided with torsion springs, it is conceivable to use short-armed torsion springs. However, the angle of rotation of the arms, which corresponds to the amount of movement of the plunger 30, is larger when using short-armed torsion springs than when using long-armed torsion springs. Accordingly, the positions at which the torsion springs are in contact with the plunger 30 largely change depending on the movement of the plunger, causing the problem that a biasing force does not act on the plunger 30 in a balanced manner.

However, since the switch 1 according to the present embodiment includes two upper torsion springs 45, namely, the upper torsion spring 45*a* arranged on one side of the plane Q and the upper torsion spring 45*b* arranged on the other side of the plane Q, it is possible for a biasing force to act on the plunger 30 in a balanced manner even if short-armed torsion springs are used and the positions at which the torsion springs are in contact with the plunger are largely changed depending on the movement of the plunger 30. Therefore, it is possible to use short-armed upper torsion springs 45, which generates space for arranging another member of the switch 1, and makes it possible to downsize the switch 1.

Moreover, in the reference position as shown in FIG. 8A, the front end portion 47*a* of the first arm 47 of the upper torsion spring 45*a* arranged on one side of the plane Q abuts against the plunger 30 on the one side of the plane Q, and the first arm 47 of the upper torsion spring 45*b* arranged on the other side of the plane Q abuts against the plunger 30 on the other side of the plane Q. Also, in the operation position as shown in FIG. 8D, the front end portion 47*a* of the first arm 47 of the upper torsion spring 45*a* is located on the other side of the plane Q, and the front end portion 47*a* of the first arm 47 of the upper torsion spring 45*b* is located on the one side of the plane Q. That is, when viewed in the direction that is perpendicular to the direction in which the first arm 47 extends and is perpendicular to the axis L, the first arm 47 of the upper torsion spring 45*a* and the first arm 47 of the upper torsion spring 45*b* do not intersect with each other in the reference position, but the first arm 47 of the upper torsion spring 45*a* and the first arm 47 of the upper torsion spring 45*b* intersect with each other in the operation position. With such a configuration, it is possible for a biasing force to act on the plunger 30 uniformly.

Furthermore, in the state shown in FIG. 8C, the front end portion 47*a* of the first arm 47 protrudes from the opening 33*b* of the hole 33. As a result of setting each hole 33 as a through-hole, it is possible to set such a length of the first arm 47 that it can protrude from the opening 33*b* of the hole 33. In other words, the distance between the contact point at which the upper torsion spring 45 is in contact with the plunger 30, and the coil wire portion 46 of the upper torsion spring 45 can be increased. Accordingly, it is possible to increase the angle of rotation of the first arm 47, which corresponds to the movement of the plunger 30. It is thus possible to arrange the upper torsion springs 45 closer to the plunger 30 than in the case of a conventional switch. As a result, space for arranging another member of the switch is generated, and it is possible to downsize the switch.

2.2 Operations of Lower Torsion Spring

Figure 9B:
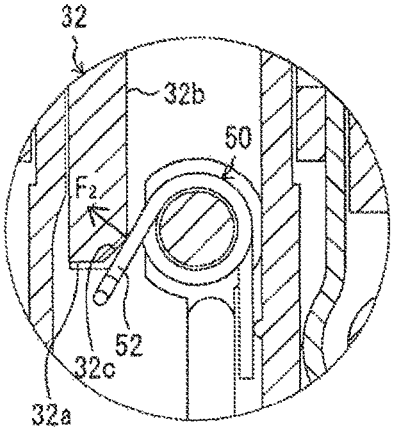
Figure 9C:
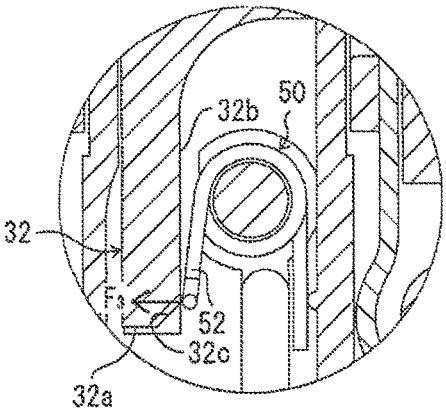
Figure 9D:
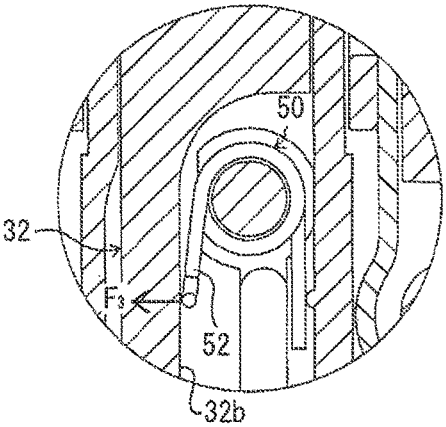

As shown in FIG. 9B, when the plunger 30 is pressed down, the first arm 52 of the lower torsion spring 50 also moves. Accordingly, the position at which the lower torsion spring 50 abuts against the plunger 30 changes, and the direction of a biasing force of the lower torsion spring 50 acting on the plunger 30 changes.

That is, in the state shown in FIG. 9A, the lower torsion spring 50 abuts against the lower end surface 32*a*, which is a surface perpendicular to the plunger returning direction, of the hanging portion 32 of the plunger 30, and a biasing force $F_1$ of the lower torsion spring 50 acts in the upward direction (returning direction). In contrast, in the state shown in FIG. 9B, the lower torsion spring 50 abuts against the inclined surface 32*c* of the hanging portion 32 of the plunger 30, and a biasing force $F_2$ of the lower torsion spring 50 acts in an inclined upward direction.

When the plunger 30 is further pressed down from the state shown in FIG. 9B, the lower torsion spring 50 abuts against the inner side surface 32*b* of the hanging portion 32 of the plunger 30. Accordingly, a biasing force $F_3$ of the lower torsion spring 50 acts in a direction different from the returning direction, and a force component acting in the returning direction is small. Thereafter, until the amount of press of the plunger 30 becomes the greatest, the lower torsion spring 50 abuts against the inner side surface 32*b* of the hanging portion 32 of the plunger 30, and the biasing force $F_3$ of the lower torsion spring 50 continues to act in the direction different from the returning direction without changing (see FIG. 9D).

Figure 10A:
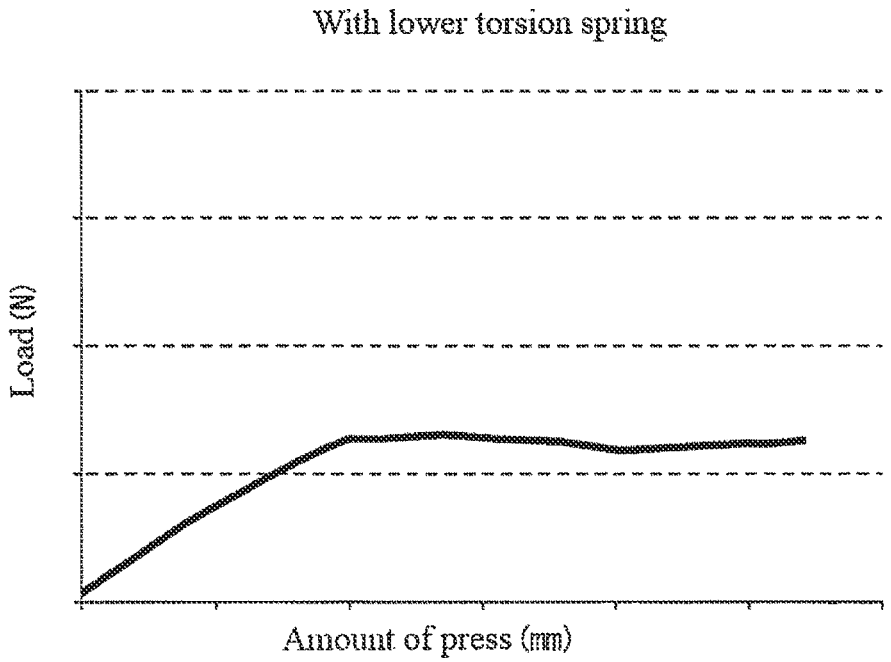
FIGS. 10A and 10B are diagrams illustrating a relationship between an amount of press of the plunger and a load.
Figure 10B:
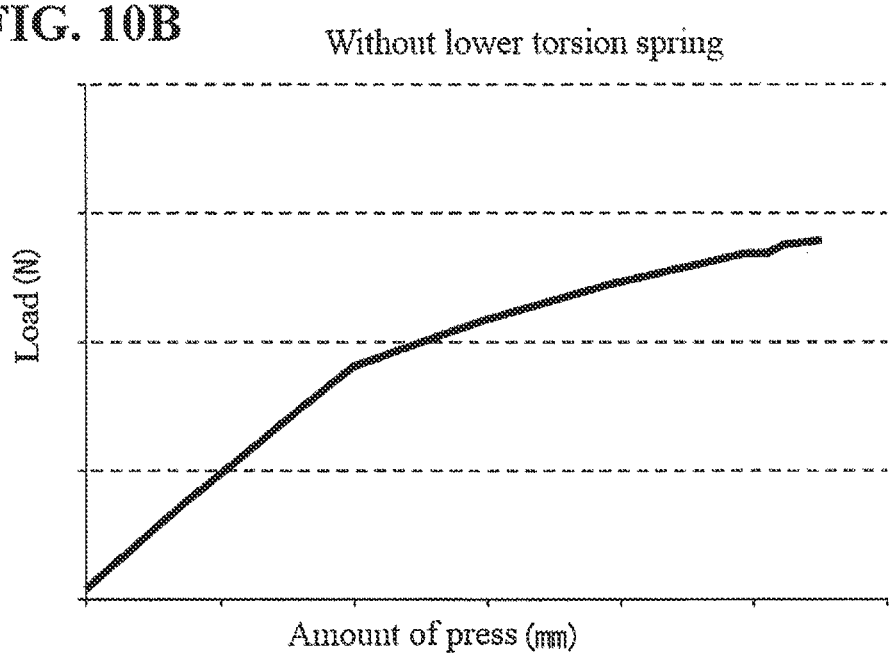

FIG. 10 are diagrams illustrating a relationship between the amount of press of the plunger 30 and the load, and specifically, FIG. 10A shows a relationship between the amount of press of the plunger 30 and the load in the case where the lower torsion spring 50 is provided, and FIG. 10B shows a relationship between the amount of press of the plunger 30 and the load in the case where no lower torsion spring 50 is provided.

The switch 1 according to the present embodiment is provided with the lower torsion spring 50 that applies a biasing force to the plunger 30, and the plunger 30 that includes the hanging portion 32 in the shape such that the direction of the biasing force of the lower torsion spring 50 is changed. Also, the lower torsion spring 50 biases, in the reference position, the plunger 30 in an upward direction, so as to place the plunger-side contacts 55*a* to 55*d* in contact with the housing-side contacts 60*a* to 60*d*.

Furthermore, when the plunger 30 is pressed down by a predetermined amount, and is located at a predetermined position between the reference position and the operation position, the biasing direction of the lower torsion spring 50 changes, and when the plunger 30 is located at a position between the predetermined position and the operation position, the lower torsion spring 50 biases the plunger 30 in a direction different from the returning direction, and the force component acting in the returning direction is small. Accordingly, as shown in FIG. 10A, the load necessary for pressing down the plunger 30 is reduced with an increase in the amount of press of the plunger 30. Accordingly, it is possible to provide the switch 1 with excellent operability while the plunger-side contacts 55*a* to 55*d* apply a contact force to the housing-side contacts 60*a* to 60*d*.

On the other hand, if the switch 1 is not provided with the lower torsion spring 50, the load increases with an increase in the amount of press of the switch 1. Here, if no lower torsion spring that changes the direction of a biasing force is provided, it is necessary to increase the biasing force of the upper torsion springs 45 in order to cause the plunger-side contacts 55*a* to 55*d* to apply a contact force to the housing-side contacts 60*a* to 60*d*. Accordingly, it is clear that the switch without a lower torsion spring that changes the direction of a biasing force has deteriorated operability because the load will increase with an increase in the amount of press of the plunger 30.

Here, as an example, a case is considered in which the switch 1 is used as an emergency stop switch. Emergency stop switches ordinarily have a mechanism that can press down the plunger 30 in response to a press-in operation performed on the operation portion 10 by an operator, irrespective of the operation load of the operator. This mechanism needs to apply a larger force to the plunger 30 than the biasing force of the spring that biases the plunger 30 in the returning direction, in order to reliably activate the emergency stop switch. The mechanism for pressing down the plunger 30 is not particularly limited, but a mechanism can be used in which, for example, an engaged compression member is provided, and as a result of being disengaged by an operation performed on the operation portion 10, the compression member compresses the plunger 30 at a predetermined pressure with a load that is unrelated to the operation load applied to the operation portion 10 by the operator.

Here, as shown in FIG. 10B, if a switch in which the load increases with an increase in the amount of press of the plunger 30 is used as an emergency stop switch, a large load is needed to press the plunger 30 down to the operation position. Accordingly, the mechanism for pressing down the plunger 30 needs to have a configuration capable of applying a large load to the plunger 30.

On the other hand, as shown in FIG. 10A, if the switch 1 in which the load necessary for pressing down the plunger 30 is reduced, even with an increase in the amount of press of the plunger 30, is used as an emergency stop switch, the load necessary for pressing down the plunger 30 is reduced. Accordingly, the load necessary for the mechanism for pressing down the plunger 30 to press down the plunger 30 is reduced, making it possible to provide the mechanism with a simple configuration.

Modifications

Figure 11:
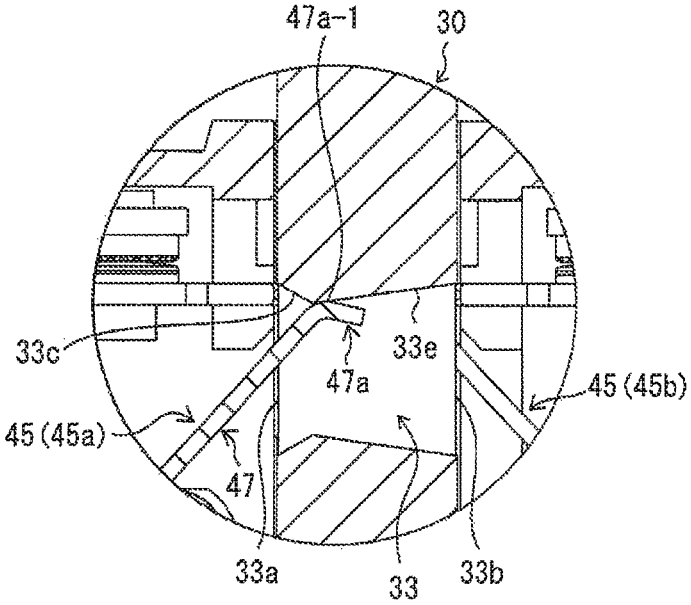
FIG. 11 is a diagram illustrating a modification of a hole formed in the plunger included in the switch according to an embodiment of the present invention.

FIG. 11 is a diagram illustrating a modification of the holes 33 formed in the plunger 30 of the switch 1 according to the present embodiment. The present embodiment has described an example in which the holes 33 formed in the plunger 30 have the upper surface 33*d* formed on a plane that is perpendicular to the direction in which the plunger 30 moves. However, the shape of the holes 33 is not limited to this. For example, as shown in FIG. 11, the holes 33 may have an upper surface (first inclined surface or the second inclined surface) 33*e* that is an inclined surface inclined in the upward direction to the opening 33*b* from the opening 33*a* side. That is, the upper surface 33*e* of the hole 33 that corresponds to the first arm 47 of the upper torsion spring 45*a* may be inclined in the returning direction from the side on which the upper torsion spring 45*a* is arranged to the side on which the upper torsion spring 45*b* is arranged, and the upper surface 33*e* of the hole 33 that corresponds to the first arm 47 of the upper torsion spring 45*b* may be inclined in the returning direction from the side on which the upper torsion spring 45*b* is arranged to the side on which the upper torsion spring 45*a* is arranged.

At a result of the upper surfaces 33*e* of the holes 33 being inclined in this way, the first arms 47 of the upper torsion springs 45 are unlikely to get caught on the plunger 30 when the plunger 30 is pressed down, making it possible to improve the operability and durability of the switch 1.

Figure 12:
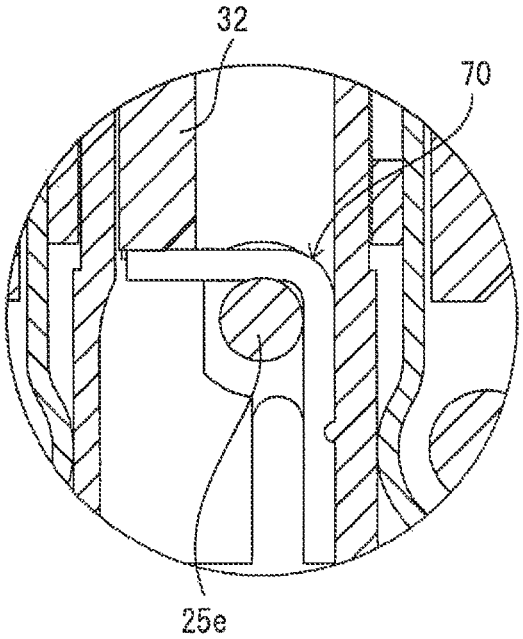
FIG. 12 is a diagram illustrating a modification of the lower torsion spring included in the switch according to an embodiment of the present invention.

Furthermore, the present embodiment has described an example in which the lower torsion spring 50, which is a torsion spring, is provided as a spring that changes the direction of a biasing force according to the amount of press of the switch 1. However, the spring only needs to change the direction in which a biasing force acts according to the amount of press of the switch 1, and thus a blade spring 70, as shown in FIG. 12 for example, may be used, instead of the lower torsion spring 50.

Figure 13:
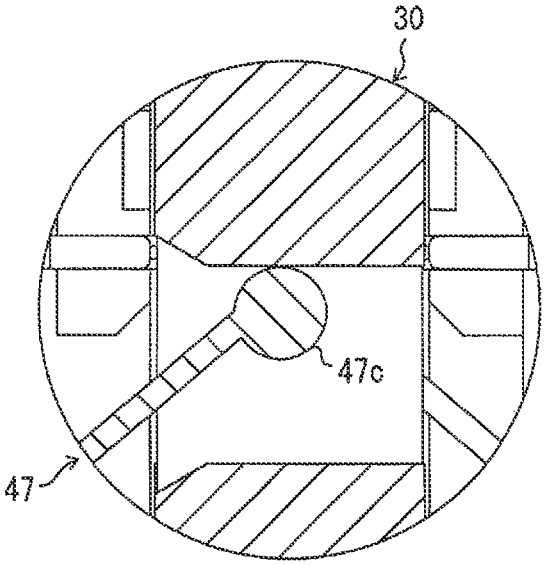
FIG. 13 is a diagram illustrating a modification of the upper torsion spring included in the switch according to an embodiment of the present invention.
Figure 14:
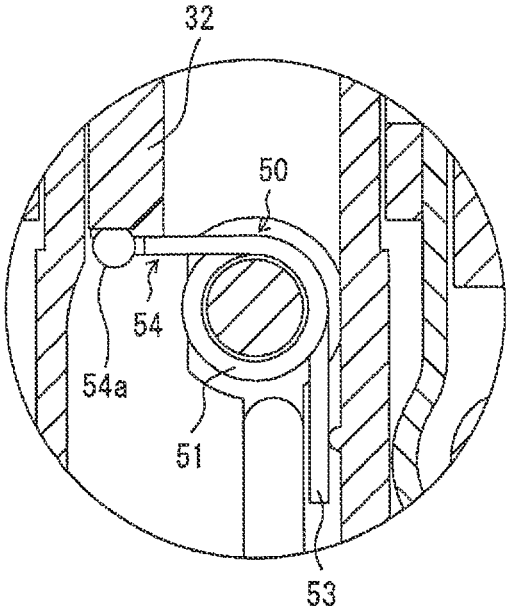
FIG. 14 is a diagram illustrating a modification of the lower torsion spring included in the switch according to an embodiment of the present invention.

Furthermore, the present embodiment has described a configuration in which the first arm 47 of each upper torsion spring 45 is provided with, at the front end thereof, the bent portion 47*a*-1, and the place at which the upper torsion spring 45 abuts against the plunger 30 is located on a curved surface, in order to prevent the first arm 47 from getting caught on the plunger 30 when the plunger 30 moves from the reference position. However, it is sufficient that the first arm 47 of the upper torsion spring 45 does not get caught on the plunger 30 when the plunger 30 moves from the reference position. For example, as shown in FIG. 13, a configuration is also possible in which the first arm 47 of the upper torsion spring 45 may be provided with, at the front end thereof, a substantially spherical slide member 47*c*. The material of the slide member 47*c* is not particularly limited as long as it is a material slidable with respect to the plunger 30, and may be, for example, a resin or the like. Furthermore, as shown in FIG. 14, a first arm 54 of the lower torsion spring 50 may be provided with, at the front end thereof, a slide member 54*a* made of a material slidable with respect to the plunger 30. Accordingly, as a result of the upper torsion springs 45 and the lower torsion spring 50 being respectively provided with the slide members 47*c* and 54*a*, the upper torsion springs 45 and the lower torsion spring 50 are unlikely to get caught on the plunger 30, making it possible to smoothly perform the operation of the switch 1.

Note that the present embodiment has described an example in which the terminals 40*a* to 40*d* are press-in type terminals, but the present invention is not limited to them. That is, the terminals 40*a* to 40*d* may be screw-type terminals.

Furthermore, the present embodiment has described an example in which the upper coil spring 65 and the lower coil spring 66 are arranged inside the plunger 30, and the upper contact-supporting member 56 is fixed to the upper coil spring 65, and the lower contact-supporting member 57 is fixed to the lower coil spring 66. However, the switch 1 does not necessarily include the upper coil spring 65 and the lower coil spring 66, and the upper contact-supporting member 56 and the lower contact-supporting member 57 may be fixed to the plunger 30, or may be formed in one piece with the plunger 30.

Furthermore, the present embodiment has described the switch 1 that includes the four terminals 40*a* to 40*d*, and is provided with the pair of housing-side contacts 60*a* and 60*b* and the pair of plunger-side contacts 55*a* and 55*b* on the upper side, and the pair of housing-side contacts 60*c* and 60*d* and the pair of plunger-side contacts 55*c* and 55*d* on the lower side. However, the configuration of the switch 1 is not limited to this. For example, the switch 1 may be a one-stage switch that includes two terminals for connecting to the outside. Furthermore, a pair of housing-side contacts and a pair of plunger-side contacts do not necessarily provided on each of the upper and lower sides, but a configuration is also possible in which a single housing-side contact and a single plunger-side contact may be provided on each of the upper and lower sides. Even in such a case, the plane Q may be a plane that is perpendicular to a perpendicular line M connecting the plunger-side contact to the axis L of the plunger 30, and includes the axis L.

The present invention is not limited to the above-described embodiments, and various modifications are possible within the scope of the claims, and the technical scope of the present invention also encompasses embodiments that can be obtained by appropriately combining the technical means disclosed in the different embodiments.

The invention claimed is:

1. A switch comprising:

an operation portion;

a fixed contact;

a movable contact;

a plunger configured to linearly move from a reference position to an operation position in response to an operation performed on an operation portion, and that is configured to open and close the fixed and the movable contacts according to the movement of the plunger; and a first torsion spring and a second torsion spring that are configured to bias the plunger in a returning direction from the operation position to the reference position, and are in contact with the plunger in the reference position, wherein the movable contact is configured to move together with the plunger, wherein a plane includes an axis that passes through a central portion of the plunger and is parallel to a direction in which the plunger moves, and is perpendicular to a perpendicular line connecting the movable contact and the axis, wherein the first torsion spring is arranged on one side of the plane, wherein the second torsion spring is arranged on the other side of the plane, and wherein an axis of rotation of a coil wire portion of each of the first and second torsion springs is stationary when the plunger moves.

2. The switch according to any one of claim 1, wherein the plunger has a first inclined surface that is provided at a position at which the first torsion spring abuts against the plunger, and a second inclined surface that is provided at a position at which the second torsion spring abuts against the plunger, the first inclined surface is inclined in the returning direction from the one side to the other side, and the second inclined surface is inclined in the returning direction from the other side to the one side.

3. The switch according to claim 1, wherein the first torsion spring and the second torsion spring are arranged at positions symmetric with respect to the axis.

4. The switch according to claim 3, wherein each of the first torsion spring and the second torsion spring has an arm that extends to the plunger, and abuts against the plunger, and the arm of the first torsion spring and the arm of the second torsion spring are provided so as to be symmetric with respect to the axis.

5. The switch according to claim 4, wherein the arms, when viewed in the direction in which the plunger moves, extend in a direction that is perpendicular to the plane, a front end portion of the arm of the first torsion spring abuts against the plunger on the one side in the reference position, and is located on the other side in the operation position, and a front end portion of the arm of the second torsion spring abuts against the plunger on the other side in the reference position, and is located on the one side in the operation position.

6. A switch comprising:

an operation portion;

a fixed contact;

a movable contact;

a plunger configured to linearly move from a reference position to an operation position in response to an operation performed on an operation portion, and that is configured to open and close the fixed and the movable contacts according to the movement of the plunger; and a first torsion spring and a second torsion spring that are configured to bias the plunger in a returning direction from the operation position to the reference position, and are in contact with the plunger in the reference position, wherein the movable contact is configured to move together with the plunger, wherein a plane includes an axis that passes through a central portion of the plunger and is parallel to a direction in which the plunger moves, and is perpendicular to a perpendicular line connecting the movable contact and the axis, wherein the first torsion spring is arranged on one side of the plane, wherein the second torsion spring is arranged on the other side of the plane, and wherein the plunger presses a distal end of each of the first and second torsion springs in an operation direction that is opposite the returning direction.

7. A switch comprising:

an operation portion;

a fixed contact;

a movable contact;

a plunger configured to linearly move from a reference position to an operation position in response to an operation performed on an operation portion, and that is configured to open and close the fixed and the movable contacts according to the movement of the plunger; and a first torsion spring and a second torsion spring that are configured to bias the plunger in a returning direction from the operation position to the reference position, and are in contact with the plunger in the reference position, wherein the movable contact is configured to move together with the plunger, wherein a plane includes an axis that passes through a central portion of the plunger and is parallel to a direction in which the plunger moves, and is perpendicular to a perpendicular line connecting the movable contact and the axis, wherein the first torsion spring is arranged on a first side of the plane, wherein the second torsion spring is arranged on a second side of the plane, and wherein, when the plunger is moved from the reference position to the operation position, a distal end of the first torsion spring crosses the plane to the second side of the plane, and a distal end of the second torsion spring crosses the plane to the first side of the plane.

* * * * *